US012196419B2

(12) United States Patent
Waldner et al.

(10) Patent No.: US 12,196,419 B2
(45) Date of Patent: Jan. 14, 2025

(54) GRATE BLOCK FOR A COMBUSTION GRATE

(71) Applicant: HITACHI ZOSEN INOVA AG, Zürich (CH)

(72) Inventors: Maurice Henri Waldner, Wettingen (CH); Werner Brennwald, Neftenbach (CH)

(73) Assignee: HITACHI ZOSEN INOVA AG, Zürich (CH)

( * ) Notice: Subject to any disclaimer, the term of this patent is extended or adjusted under 35 U.S.C. 154(b) by 519 days.

(21) Appl. No.: 17/625,030

(22) PCT Filed: Apr. 6, 2020

(86) PCT No.: PCT/EP2020/059704
§ 371 (c)(1),
(2) Date: Jan. 5, 2022

(87) PCT Pub. No.: WO2021/004664
PCT Pub. Date: Jan. 14, 2021

(65) Prior Publication Data

US 2022/0260252 A1 Aug. 18, 2022

(30) Foreign Application Priority Data

Jul. 5, 2019 (EP) ..... 19184559

(51) Int. Cl.
*F23H 17/12* (2006.01)
*F23H 3/02* (2006.01)

(52) U.S. Cl.
CPC ..... *F23H 17/12* (2013.01); *F23H 3/02* (2013.01)

(58) Field of Classification Search
CPC ..... F23H 17/12; F23H 3/02
See application file for complete search history.

(56) References Cited

U.S. PATENT DOCUMENTS 1,409,205 A * 3/1922 Van Brunt ..... F23H 3/02 110/328
4,876,972 A * 10/1989 Mrklas ..... F23L 1/02 110/298

(Continued)

FOREIGN PATENT DOCUMENTS

DE 23 45 734 A1 3/1975
DE 4026587 C1 10/1991

(Continued)

OTHER PUBLICATIONS

Jul. 8, 2020 International Search Report issued in International Patent Application No. PCT/EP2020/059704.

(Continued)

*Primary Examiner* — David J Laux
(74) *Attorney, Agent, or Firm* — Oliff PLC

(57) ABSTRACT

A grate block for a combustion grate, wherein consecutive grate blocks are arranged one over the other in a staircase manner and rearrange to convey the combustible material during combustion by means of pushing motions performed in relation to each other. The grate block includes a block body including an upper wall forming a bearing surface, along which wall the combustible material is conveyed, and a front wall forming a push surface, which has first air supply openings formed by a first air supply channel for feeding air to the combustion grate, and a lower bearing edge intended to come into contact with the bearing surface of a grate block located adjacent in the pushing direction S. Further air supply channels, which traverse and are directed obliquely with respect to the direction of the first air supply channels, are arranged in the upper and front walls for cooling the walls.

11 Claims, 2 Drawing Sheets

(56) References Cited

U.S. PATENT DOCUMENTS

Figure 1:
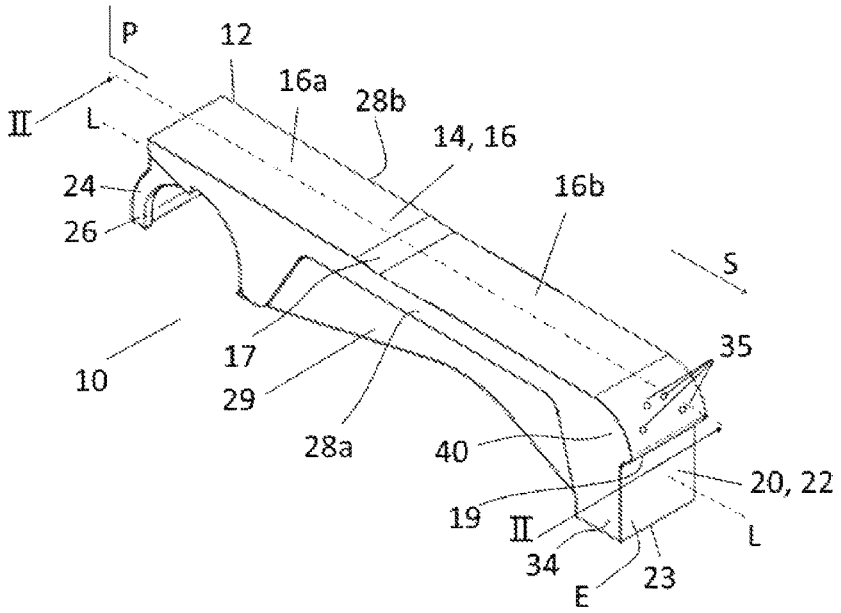

| | | | | |
|---|---|---|---|---|
| 6,302,038 | B1 * | 10/2001 | Seo | F23H 17/00 126/152 A |
| 2014/0283718 | A1 * | 9/2014 | Penski | F23H 17/02 29/402.08 |
| 2021/0364164 | A1 * | 11/2021 | Martin | F23H 7/08 |

FOREIGN PATENT DOCUMENTS

| | | | |
|---|---|---|---|
| DE | 195 02 261 | A1 | 8/1995 |
| FR | 2 233 564 | A1 | 1/1975 |
| JP | 2013-195052 | A | 9/2013 |
| WO | 2016/198119 | A1 | 12/2016 |

OTHER PUBLICATIONS

Sep. 3, 2024 Office Action issued in Japanese Patent Application No. 2022-500055.

* cited by examiner

GRATE BLOCK FOR A COMBUSTION GRATE

The invention relates to a grate block for a combustion grate, according to the preamble of claim 1. The invention further relates to a combustion grate comprising at least one such grate block. The invention furthermore relates to the use of said combustion grate for the incineration of waste and to a waste incineration plant comprising such a combustion grate.

Combustion grates for the large-scale incineration of waste have been known to the person skilled in the art for a long time. Such combustion grates can be present in the form of thrust combustion grates for instance, which include moving parts that are suitable for carrying out stoking strokes. The incinerator charge here is conveyed from an inlet-side end of the combustion grate to the outlet-side end thereof and is combusted during this time. In order to supply the combustion grate with the oxygen required for combustion, appropriate air supply lines are provided, which pass through the combustion grate and through which the air, also referred to as primary air, is introduced.

A frequently used combustion grate is the so-called step grate. The latter comprises grate blocks which are disposed next to one another and form in each case a row of grate blocks. The rows of grate blocks here are disposed one on top of one another in the manner of steps, wherein in so-called moving grates the front end of a grate block, when viewed in the thrust direction, bears on a bearing face of the grate block adjacent in the transport direction and in the event of a corresponding thrust movement is moved on this bearing face.

In the case of so-called reversing grates, the grate blocks are disposed so as to be rotated by approximately 180° in relation to the moving grates, when viewed in the transport direction of the incinerator charge. Therefore, in the case of reversing grates, the front end of the grate block, when viewed in the thrust direction, bears on a bearing face of the respective preceding grate block. In contrast to moving grates, the thrust direction, in the case of reversing grates, is thus opposed to the transport direction resulting from the inclination of the reversing grate.

A combustion grate configured as a step grate and a grate block for such a combustion grate are described, for example, in WO 2016/198119, the latter relating to an air-cooled grate block. Specifically, the grate block described in WO 2016/198119 A1 comprises a block body which is configured as a casting, has an upper wall forming a bearing face for the waste to be treated and has a front wall forming a thrust face. Configured in the lower region of the front wall is a foot which is specified to bear displaceably on the bearing face of a grate block adjacent in the thrust direction, while air supply openings for introducing air are disposed in the front wall.

As a result of the incinerator charge being conveyed over the grate blocks, the latter are generally exposed to a relatively high level of wear and tear. The abrasion here is particularly high in the region of the foremost end of the bearing face, where the incinerator charge is dropped from the bearing face of the grate block via a corresponding discharge edge onto the bearing face of the following grate block. In particular, this can also lead to erosion of the air supply openings disposed under the edge, which can compromise the controlled air supply to the combustion bed lying on the combustion grate.

Grate blocks are also exposed to a very high thermal load, mainly because of the high temperatures during incineration, or in the combustion chamber. In the normal operation of the combustion grate, this thermal load is particularly high in the region of the bearing face, although the combustion material lying on the grate block has an insulating effect to a certain extent.

Very high loads arise when the incinerator charge is unevenly distributed on the combustion grate and only forms a thin insulating layer, or when this insulating layer is completely absent. The thermal load promotes erosion through abrasion and chemical reactions taking place on the bearing face, this further damaging the bearing face. This ultimately leads to a reduction in the service life of the grate block.

The object to be achieved according to the invention is thus to provide a grate block mentioned at the outset which has a long service life and in which the erosion of the bearing face, in particular the erosion of the foremost end of the grate block, is minimized.

This object is achieved by the grate block defined in independent claim 1.

Preferred embodiments of the grate block according to the invention are reflected in the dependent claims.

According to claim 1, the present invention thus relates to a grate block for a combustion grate, in which successive grate blocks are disposed one on top of one another in the manner of steps and are designed in such a manner that the incinerator charge is shifted and conveyed during the combustion by means of thrust movements performed relative to one another, i.e. by means of relative movements between the grate blocks. As mentioned at the outset, such combustion grates are also referred to as step grates.

Furthermore, the grate block comprises a block body which is preferably configured as a casting. The block body typically is configured substantially in the form of an elongate cuboid with a longitudinal axis L.

The block body comprises an upper wall which forms a bearing face running parallel to the longitudinal axis L, along which the incinerator charge is to be conveyed and which defines an incinerator charge side of the upper wall.

When viewed in a thrust direction S, the foremost end of the bearing face forms an edge by way of which the bearing face descends into a thrust face formed by a front wall. The edge thus forms a transition between the upper wall and the front wall.

The side of the upper wall that faces away from the bearing face and the side of the front wall that faces away from the thrust face define a cooling air side of the block body.

The thrust direction S identifies the direction in which the incinerator charge is pushed by the thrust face of the grate block. The thrust direction S typically is parallel to the longitudinal axis L.

The transport direction T identifies the direction of movement of the incinerator charge from an inlet to an outlet of the combustion grate. The transport direction T is derived mainly from the inclination of the combustion grate.

The front wall has first air supply openings which are formed by first air supply ducts that, when viewed in the longitudinal section, run orthogonally or obliquely to the thrust face for supplying air to the combustion grate.

In the following, the term "air" comprises the so-called primary air which is supplied to the combustion grate or the combustion bed on the combustion grate. The primary air primarily contributes to the burnout of the incinerator charge but at the same time also to the cooling of the grate blocks of the combustion grate.

Furthermore, the front wall is designed in the lowermost region thereof in the form of a foot which is specified to bear on the bearing face of a grate block that is adjacent in the thrust direction.

According to one preferred embodiment, the first air supply ducts, when viewed in the longitudinal section, run at an angle $\alpha$ to the region of the thrust face that is directly adjacent to the respective first air supply openings, where a is in a range from 90° to 135°, preferably from 95° to 125°, particularly preferably from 100° to 120°, and most preferably from 105° to 115°. The angle $\alpha$ is measured in the counterclockwise manner between the longitudinal axis of the respective first air supply ducts and the thrust face. As a result, an optimal air supply to the combustion grate or to the combustion bed on the combustion grate is obtained, which contributes to a very high burnout of the incinerator charge. The portion of the first air supply ducts that is relevant for determining the angle $\alpha$ is the portion directly in front of the exit of the respective first air supply duct from the front wall.

In one preferred embodiment, in which the grate block according to the invention is specified for a moving grate, the foot thus bears on the grate block, or the bearing face thereof, that follows in the transport direction T of the incinerator charge. It is also conceivable, however, that the grate block according to the invention is specified for a reversing grate; in this case, the foot bears on the grate block, or the bearing face thereof, that is preceding in the transport direction T of the incinerator charge.

At least the lower bearing edge of the thrust face is disposed in a plane E running substantially orthogonally to the longitudinal axis L. In this regard, it is conceivable that a face disposed in the lowermost region of the front wall, the lower end of said face being formed by the lower bearing edge, is disposed in the plane E. However, it is also conceivable that only the line described by the lower bearing edge is disposed in the plane E.

According to the invention, further air supply ducts that extend through into the upper wall and into the front wall and are aligned obliquely to the direction of the first air supply ducts are configured for cooling the upper wall and the front wall, wherein the further air supply ducts form further air supply openings in the upper wall, i.e. in the bearing face, and in the front wall, i.e. in the thrust face. As a result, it can be guaranteed that the distribution of the air for cooling the upper wall and the front wall is optimized. Consequently, the heat is dissipated better, so that the upper wall and the front wall are subject to reduced erosion.

In one preferred embodiment, the upper wall and the front wall, in that region where said upper wall and said front wall meet, when viewed in the longitudinal section, are configured in thickened form as a wall thickening. The wall thickening in that region of the grate block that is exposed to particularly severe wear can increase the service life of the grate block, since significantly greater abrasion can be tolerated.

In one particularly preferred embodiment, the wall thickening, when viewed in the longitudinal section, is configured in such a manner that the edge, when viewed in the thrust direction S, is set forward in relation to the plane E. In other words, that region of the thrust face in which the first air supply openings and possibly further air supply openings are disposed is disposed in a plane which is set back along the longitudinal axis L and, when viewed in the thrust direction S, in relation to the edge. Since the edge, when viewed along the longitudinal axis L and in the thrust direction S, is set forward in relation to the plane E, the first air supply openings and possibly the further air supply openings, which are formed below the edge, are at least partially protected. This arrangement has the additional advantage that the air can exit more easily through the first air supply openings and the further air supply openings. Better cooling of the front wall is thus achieved.

In a preferred embodiment, the wall thickening, when viewed in the longitudinal section, is configured in a curved manner, for example in the form of a bead. As a result of the curved configuration of the wall thickness it is ensured that the incinerator charge can be transported unhindered over the grate block, i.e. without being blocked by any angular unevennesses.

The term thickening of the upper or front wall is to be understood such that the upper and front wall, in the region in which said walls are configured so as to be thickened, have a greater wall thickness than in the directly surrounding region of the thickening.

The wall thickening, by virtue of the additional amount of material forming the wall thickening, is able to absorb additional heat during operation of the grate block. On the one hand, the wall thickening consequently enables the grate block to last longer because the thickened upper or front wall resists erosion over a longer time. On the other hand, however, the erosion of the wall thickening can increase due to the strong thermal load. Another optimization of the grate block thus lies in optimizing the cooling of the wall thickening.

In one preferred embodiment, the further air supply ducts are disposed in the wall thickening, that is to say that said further air supply ducts extend through the wall thickening. As a result of this arrangement of the further air supply ducts and the corresponding further air supply openings, better cooling of the wall thickening by air is guaranteed, and the erosion of said wall thickening is thus reduced.

However, it is also possible for the further air supply ducts to be disposed only in the upper wall, i.e. above the edge of the upper wall. Since the erosion due to abrasion mainly takes place on the bearing face, the wall thickening on the upper wall is advantageously formed predominantly in that region in which the upper wall and the front wall meet. This arrangement of the further air supply ducts thus allows optimized cooling of the wall thickening.

In one preferred embodiment, the further air supply ducts, when viewed in the longitudinal section, run at an angle $\beta$ to the longitudinal axis L of the block body, wherein the angle $\beta$ is from 10° to 60°. The angle $\beta$ is measured in a counterclockwise manner in relation to the longitudinal axis L. As a result of the further air supply ducts running obliquely to the longitudinal axis L of the block body, said further air supply ducts are longer than if they would run parallel to the longitudinal axis L. Consequently, the air flowing through the further air supply ducts can bring about efficient cooling.

The angle $\beta$, is preferably from 15° to 50°. The angle $\beta$, is chosen in such a manner that the slag resulting from the combustion of the incinerator charge drops to the least possible extent through the further air supply ducts and causes blockage. Reliable cooling of the grate block is thus guaranteed.

In one preferred embodiment, a first group of the further air supply ducts is formed in a first plane that runs at a first angle $\beta$1 to the bearing face of the block body. Furthermore, a second group of the further air supply ducts is formed in a second plane that runs at a second angle $\beta$2 to the bearing face of the block body. The first angle $\beta$1 here is from 10° to 35°, preferably from 10° to 20°, and the second angle $\beta$2 is from 35° to 60°, preferably from 40° to 50°. A division of the further air supply ducts into groups and the distribution of the latter into planes ensures that the air flowing through the further air supply ducts has the effect of efficiently distributed cooling around these planes. As a result, the service life of the grate block can be extended.

In one preferred embodiment, the further air supply ducts of the first group and the further air supply ducts of the second group are configured parallel to one another. The further air supply ducts of the first group and the further air supply ducts of the second group are preferably configured parallel to a longitudinal section plane P that encompasses the longitudinal axis L orthogonally to the bearing face. This arrangement has the additional advantage that the production of the further air supply ducts is simplified.

In one preferred embodiment, the further air supply ducts in the first plane and/or in the second plane are distributed so as to be uniformly spaced apart from one another across the width of the grate block. As a result, it is ensured that the air flowing through the further air supply ducts brings about homogeneous cooling about these planes. Thus, the distribution of the stresses caused by the heat distribution, during operation of the grate block, is also distributed homogeneously in the first and the second plane, and the formation of cracks in the grate block across the width thereof is minimized. This leads to an extension of the service life of the grate block.

In one preferred embodiment, a further air supply duct, optionally a further air supply duct of the first group and a further air supply duct of the second group, and a first air supply duct are in each case disposed in the same plane which runs parallel to the longitudinal section plane P. This arrangement of the first and the further air supply ducts ensures that the stresses during operation of the grate block, when viewed in the longitudinal section, are also distributed homogeneously. Thus, the generation of cracks can be minimized.

In one preferred embodiment, the further air supply ducts are distributed symmetrically to a longitudinal plane of symmetry of the grate block that runs orthogonally to the bearing face. This arrangement has the further advantage that the production of the further air supply ducts is simplified.

The number of air supply ducts and of further air supply ducts is calculated proportionally to the width of the grate block and to the size of the wall thickening in order to achieve optimized cooling of the grate block.

In one preferred embodiment, the further air supply ducts, substantially across the length thereof, have a consistent cross-sectional area which is, in particular, 40 mm2 to 100 mm2. The diameter is chosen in such a manner that the slag resulting from the combustion of the incinerator charge drops to the least possible extent through the further air supply ducts and causes a blockage. Reliable cooling of the grate block can thus be guaranteed. The cross-sectional area is preferably 80 mm2 in order for an optimal result to be achieved.

In one preferred embodiment, the further air supply ducts across the length thereof are configured so as to widen continuously from the incinerator charge side to the cooling air side, wherein the cross-sectional area of the further air supply ducts on the incinerator charge side and the cross-sectional area of the further air supply ducts on the cooling air side are at a ratio of 1:1.2 to 1:2.5, preferably 1:2.25. The cross-sectional area of the further air supply ducts on the incinerator charge side is measured in the bearing face, or in the thrust face, and corresponds to the cross-sectional area of the further air supply openings defined above. The cross-sectional area of the further air supply ducts is measured on the end thereof lying on the cooling air side. This configuration of the further air supply ducts enables the combustion residues that have entered the further air supply ducts to be easily discharged. Specifically, the combustion residues, in the direction of the cooling air side, are pressed further into the further air supply ducts by the incinerator charge on the grate block and released because of the widening of the further air supply ducts. A blockage of the air supply can thus be avoided.

According to a further aspect, the present invention moreover relates to a combustion grate comprising at least one of the grate blocks described above.

Figure 2:
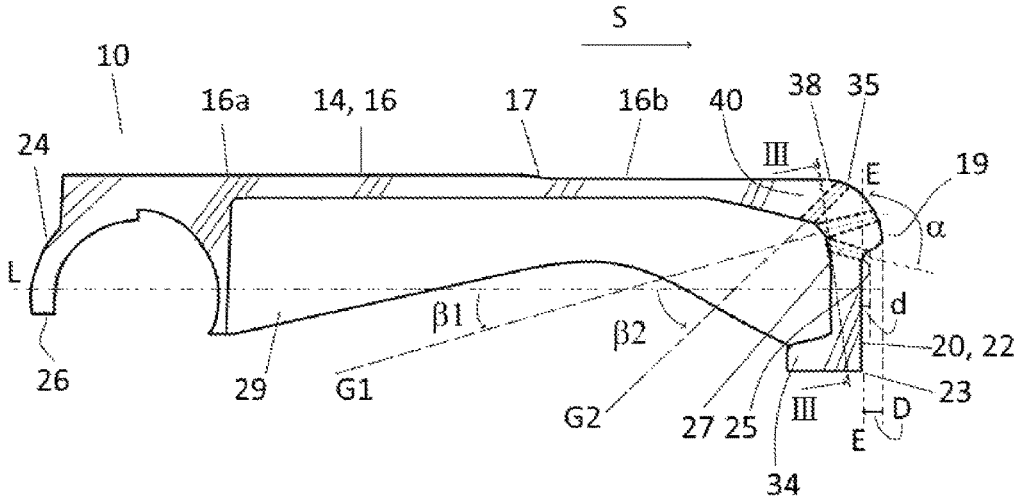
Figure 3:
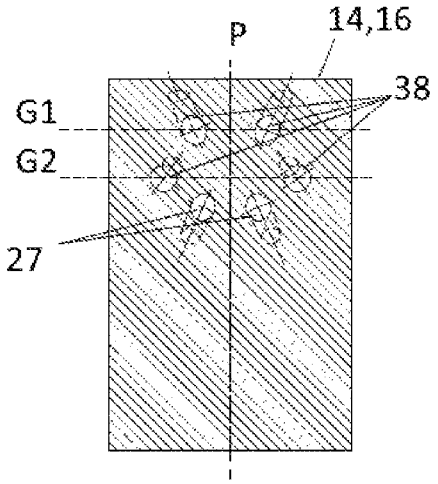

Furthermore, the present invention relates to the use of a combustion grate described above for the incineration of waste and to a waste incineration plant comprising such a combustion grate. The invention is illustrated by means of the appended figures, in which:

FIG. 1 shows a grate block according to the invention in a perspective view; and FIG. 2 shows a fragment of the grate block according to FIG. 1 in the longitudinal section through the section plane II-II shown in FIG. 1; and FIG. 3 shows a fragment of the grate block according to FIG. 1 in cross section through the section plane III-III shown in FIG. 2.

As can be seen from FIG. 1, the grate block 10 comprises a block body 12 which is configured as a casting and configured substantially in the form of an elongate cuboid with a longitudinal axis L.

The block body 12 comprises an upper wall 14 which forms a bearing face 16 which runs parallel to the longitudinal axis L and along which the incinerator charge is to be conveyed and which defines an incinerator charge side of the upper wall 14. The foremost end of the bearing face 16, when viewed in the thrust direction S, forms an edge 19 by way of which the bearing face 16 descends into a thrust face 22 formed by a front wall 20. The side of the upper wall 14 that faces away from the bearing face and the side of the front wall 20 that faces away from the thrust face 22 define a cooling air side of the block body 12.

In the embodiment shown, the bearing face has a first bearing face region 16*a* and a second bearing face region 16*b*, wherein the first bearing face region 16*a* is however disposed offset upward in relation to the second bearing face region 16*b* and connected by way of a beveled transition 17 to the latter.

On the side opposite the front wall 20, the block body 12 has a rear wall 24 which is equipped with at least one hook 26 with which the grate block 10 can be hooked into a block mounting tube. A central web 29 is also disposed on the lower side of the grate block 10 that faces away from the bearing face 16.

The grate block 10 is laterally delimited in each case by a lateral wall 28*a*, 28*b* that extends in the longitudinal direction L.

Within the combustion grate, the grate block 10 bears on a grate block that follows in the thrust direction S. To this end, the lowermost region of the front wall 20 is configured in the form of a block 34 which is specified to bear on the bearing face of a grate block adjacent in the thrust direction S. The lowermost region, including a lower bearing edge 23 of the thrust face configured by said lowermost region, is disposed in a plane E which runs substantially orthogonally to the longitudinal axis L.

Furthermore, the grate block 10, in that region in which the upper wall 14 and the front wall 20 meet, is configured so as to be thickened. Specifically, the wall thickening 40, when viewed in the longitudinal section, is configured so as to be curved on the incinerator charge side of the upper wall 14.

The edge 19 formed by the wall thickening 40 in the embodiment shown is set forward along the longitudinal axis L and, when viewed in the thrust direction S, in relation to the plane E, wherein the distance D between the edge 19 and the plane E is approx. 25 mm.

Thus, in the embodiment shown, the second bearing face region 16*b* runs first substantially in one plane and subsequently in a descending manner in a curved region which, when viewed in the thrust direction S, extends up to the foremost end of the bearing face 16.

The edge 19 formed by the foremost end of the bearing face 16 in the present case is situated below the plane of the second bearing face region 16*b*. The thrust face 22 begins over the edge 19 and first runs in set back form in relation to the edge 19 and subsequently extends into the plane E.

As can be seen from FIGS. 2 and 3, the front wall 20 has two first air supply openings 25 which are in each case formed by a first air supply duct 27 that extends through the front wall 20. In the present case, the first air supply ducts 27 open into an undercut of the front wall 20 that is formed by the wall thickening 40 and the plane E. The first air supply openings 25 in FIG. 1 are situated below the wall thickening 40 and are not visible. Primary air is supplied to the combustion grate, or the combustion bed on the combustion grate, through the first air supply ducts 27.

Moreover, the first air supply openings 25 along the longitudinal axis L and when viewed in the thrust direction S are set back in relation to the edge 19, in the specifically shown embodiment by a distance d of approximately 12 mm.

In the grate block illustrated in FIG. 2, the first air supply ducts 27, when viewed in the longitudinal section, in the region thereof that is directly adjacent to the respective air supply opening, run at an angle $\alpha$ of approximately 110° to the thrust face 22.

Furthermore, the grate block 12 comprises further air supply ducts 38 for cooling the upper wall 14, which run through into the upper wall 14, are disposed in the wall thickening 40 and aligned obliquely to the direction of the first air supply ducts 27, wherein the further air supply ducts 38 form further air supply openings 35 in the wall thickening 40.

In the embodiment shown, a first group of two further air supply ducts 38 is configured in a first plane G1 that runs at a first angle $\beta$1 to the bearing face 16. Furthermore, a second group of two further air supply ducts 38 is configured in a second plane G2 running at a second angle $\beta$2 to the bearing face 16. The first angle $\beta$1 here is 15°, and the second angle $\beta$2 is 45°. For the sake of clarity, the angles $\beta$1 and $\beta$2 in FIG. 2 are illustrated in relation to the longitudinal axis L which runs parallel to the bearing face 16.

As is illustrated in FIG. 3, the two first air supply ducts 27 and the two groups of two further air supply ducts 38 are each distributed in pairs so as to be symmetrical to a longitudinal plane of symmetry P of the grate block 12 that runs orthogonally to the bearing face.

Furthermore, the two first air supply ducts 27 and the two groups of two further air supply ducts 38, when viewed in the direction toward the interior of the grate block 12, are configured so as to widen continuously so that combustion residues that have entered the first or the further air supply ducts 27 or 38 can be discharged more easily and a blockage of the air supply can thus be avoided. The diameter of the first and the further air supply ducts 27 and 38, at the end thereof that faces the interior of the grate block 10 here is 15 mm and at the other end thereof is 10 mm.

In operation, the grate blocks 10 are moved relative to one another by means of the block mounting tubes. Depending on whether the block mounting tubes are assigned to a stationary or a movable grate block, the block mounting tubes are either attached to stationary consoles or to consoles which are disposed in a movable grate carriage. The driving takes place by hydraulic cylinders, which move the grate carriages back and forth over rollers on corresponding running surfaces.

As a result of the relative movement obtained in this way, the foot 34 of a first grate block 10 is pushed back and forth over the bearing face 16 of the respectively subsequent grate block 10, wherein the incinerator charge is conveyed across the bearing face 16 before being dropped over the edge 19 onto the bearing face 16 of the following grate block 10.

LIST OF REFERENCE SIGNS

Grate block 10
Block body 12
Upper wall 14
Bearing face 16
Bearing face region 16*a*, 16*b*
Transition 17
Edge 19
Front wall 20
Thrust face 22
Lower bearing edge 23
Rear wall 24
First air supply opening 25
Hook 26
First air supply duct 27
Lateral wall 28*a*, 28*b*
Central web 29
Block 34
Further air supply opening 35
Further air supply duct 38
Wall thickening 40
Longitudinal axis L
Thrust direction S
Plane E
Longitudinal section plane P
Distance d by which the air supply openings are set back in relation to the edge along the longitudinal axis L and when viewed in the thrust direction S
Distance D by which the edge along the longitudinal axis L and when viewed in the thrust direction S is set forward in relation to the plane E
Angle $\alpha$
Angle $\beta$1, $\beta$2

The invention claimed is:

1. A grate block for a combustion grate, in which successive grate blocks are disposed one on top of one another in the manner of steps and are designed in such a manner that the incinerator charge is shifted and conveyed during the combustion by means of thrust movements performed relative to one another, wherein the grate block has a block body which has an upper wall and defines a longitudinal axis L, wherein the upper wall forms a bearing face along which the incinerator charge is to be conveyed and the foremost end thereof, when viewed in a thrust direction S aligned substantially parallel to the longitudinal axis L forms an edge by way of which the bearing face descends into a thrust face formed by a front wall, the front wall has first air supply openings which are in each case formed by a first air supply duct for supplying air onto the combustion grate that, when viewed in the longitudinal section, runs orthogonally or obliquely to the thrust face, and has a lower bearing edge which is disposed in a plane E running substantially orthogonally to the longitudinal axis L and is specified for coming into contact with the bearing face of a grate block adjacent in the thrust direction S, characterized by further air supply ducts for cooling the upper wall and the front wall that extend through the upper wall and the front wall and are aligned obliquely to the direction of the first air supply ducts, wherein the further air supply ducts, when viewed in the longitudinal section, run at an angle β to the longitudinal axis L of the block body, where β is from 10° to 60°.

2. The grate block as claimed in claim 1, wherein the upper wall and the front wall, in that region where the upper wall and the front wall meet, when viewed in the longitudinal section, are configured in thickened form as a wall thickening, and in that the edge, when viewed in the thrust direction S, is set forward in relation to the plane E.

3. The grate block as claimed in claim 2, wherein the further air supply ducts are disposed in the wall thickening.

4. The grate block as claimed in claim 1, wherein a first group of the further air supply ducts are configured in a first plane that runs at a first angle β1 to the bearing face of the block body, and a second group of the further air supply ducts are configured in a second plane that runs at a second angle β2 to the bearing face of the block body, where β1 is from 10° to 35°, and β2 is from 35° to 60°.

5. The grate block as claimed in claim 4, wherein the further air supply ducts of the first group are configured so as to be parallel to one another, and the further air supply ducts of the second group are configured so as to be parallel to one another.

6. The grate block as claimed in claim 4, wherein the further air supply ducts in the first plane and/or in the second plane are distributed so as to be at least approximately uniformly spaced apart from one another across the width of the grate block.

7. The grate block as claimed in claim 1, wherein the further air supply ducts are distributed symmetrically to a longitudinal plane of symmetry of the grate block that runs orthogonally to the bearing face.

8. The grate block as claimed in claim 1, wherein the further air supply ducts, substantially across the length thereof, have a consistent cross-sectional area which is 40 $mm^2$ to 100 $mm^2$.

9. The grate block as claimed in claim 1, wherein the further air supply ducts across the length thereof are configured so as to widen continuously from the incinerator charge side to the cooling air side, wherein the cross-sectional area of the further air supply ducts on the incinerator charge side and the cross-sectional area of the further air supply ducts on the cooling air side are at a ratio of 1:1.2 to 1:2.5.

10. A combustion grate comprising at least one grate block as claimed in claim 1.

11. A waste incineration plant comprising a combustion grate as claimed in claim 10.

* * * * *